US007392918B2

(12) United States Patent
Holloway et al.

(10) Patent No.: US 7,392,918 B2
(45) Date of Patent: Jul. 1, 2008

(54) METHOD AND DEVICE FOR PILL DISPENSING

(75) Inventors: Lawrence E. Holloway, Versailles, KY (US); John T. Henninger, Lexington, KY (US); Richard D. Muse, Georgetown, KY (US); Anthony J. McEldowney, Lexington, KY (US); Robert B. Muncy, Jr., Lexington, KY (US); William R. Dieter, Lexington, KY (US); Robert A. Lodder, Lexington, KY (US)

(73) Assignee: R.A.M.M., LLC, Paris, KY (US)

( * ) Notice: Subject to any disclaimer, the term of this patent is extended or adjusted under 35 U.S.C. 154(b) by 33 days.

(21) Appl. No.: 10/573,342

(22) PCT Filed: May 28, 2004

(86) PCT No.: PCT/US2004/017228

§ 371 (c)(1),
(2), (4) Date: Mar. 24, 2006

(87) PCT Pub. No.: WO2005/041137

PCT Pub. Date: May 6, 2005

(65) Prior Publication Data

US 2007/0023444 A1 Feb. 1, 2007

Related U.S. Application Data

(60) Provisional application No. 60/509,319, filed on Oct. 7, 2003.

(51) Int. Cl.
*G07F 11/16* (2006.01)

(52) U.S. Cl. ..... 221/151; 221/277; 221/248; 221/154

(58) Field of Classification Search ..... 221/132
See application file for complete search history.

(56) References Cited

U.S. PATENT DOCUMENTS

| | | | | |
|---|---|---|---|---|
| 3,682,353 | A * | 8/1972 | Roast | 221/277 |
| 3,833,117 | A * | 9/1974 | Mackenzie et al. | 209/3 |
| 4,078,661 | A | 3/1978 | Thomas | |
| 4,245,742 | A | 1/1981 | Rossmo | |
| 4,501,380 | A * | 2/1985 | Welch | 221/298 |
| 4,524,869 | A | 6/1985 | Nader | |
| 4,573,606 | A | 3/1986 | Lewis et al. | |
| 5,372,276 | A | 12/1994 | Daneshvar | |
| 5,452,822 | A * | 9/1995 | Haymond | 221/155 |
| 5,507,277 | A | 4/1996 | Rubsamen et al. | |
| 5,694,919 | A | 12/1997 | Rubsamen et al. | |
| 5,724,957 | A | 3/1998 | Rubsamen et al. | |
| 5,735,263 | A | 4/1998 | Rubsamen et al. | |
| 5,782,378 | A * | 7/1998 | Hart et al. | 221/24 |
| 5,876,368 | A | 3/1999 | Flower | |
| 5,909,822 | A | 6/1999 | George et al. | |
| 6,032,085 | A | 2/2000 | Laurent et al. | |

(Continued)

*Primary Examiner*—Gene O. Crawford
*Assistant Examiner*—Timothy R Waggoner
(74) *Attorney, Agent, or Firm*—King & Schickli, PLLC

(57) ABSTRACT

A pill dispenser (10) and a related method of pill dispensing including a container (12) having a holder (14), a gate (16), a controller (18) a sensor (20) and a neutralizing device (22). The dispenser (10) releases pills at a prescribed release rate. The sensor (20) detects tampering with the container (12). Upon detection of tampering, the neutralizing device (22) renders the contents of the pill dispenser (10) impotent.

36 Claims, 8 Drawing Sheets

U.S. PATENT DOCUMENTS 6,039,251 A 3/2000 Holowko et al.
6,048,087 A 4/2000 Laurent et al.
6,098,835 A 8/2000 DeJonge
6,182,861 B1 * 2/2001 Kovens et al. ..... 221/258
6,286,714 B1 * 9/2001 Pearson et al. ..... 221/164
6,302,292 B1 10/2001 Schafer et al.
6,431,399 B2 8/2002 Gabel et al.
6,520,374 B1 * 2/2003 Chang ..... 221/113
6,551,298 B1 4/2003 Zhang et al.

* cited by examiner

FIG. 7b
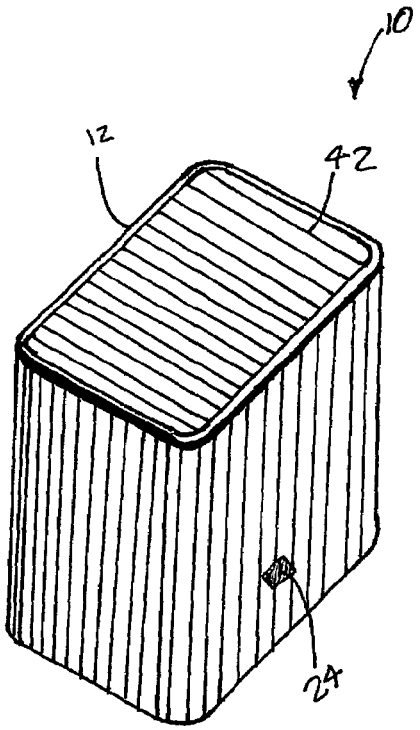
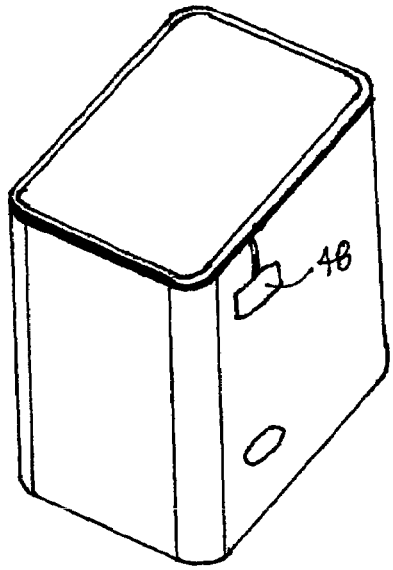
FIG. 10

METHOD AND DEVICE FOR PILL DISPENSING

This application claims the benefit of U.S. Provisional Patent Application Ser. No. 60/509,319, filed Oct. 7, 2003, herein incorporated by reference.

TECHNICAL FIELD

The present invention relates generally to pill containers and, in particular, to a method and device for pill dispensing. In particular, it relates to a pill dispenser that dispenses pills no faster than a prescribed rate. Even more particularly, it relates to a pill dispenser that detects tampering and includes provisions for neutralization of the dispenser contents upon such detection.

COPYRIGHTED MATERIALS

A portion of the disclosure of this patent document contains materials to which a claim of copyright protection is made. The copyright owner has no objection to the reproduction by anyone of the patent document or the patent disclosure as it appears in the U.S. Patent and Trademark Office patent files or records, but reserves all other rights with respect to the copyrighted work.

BACKGROUND OF THE INVENTION

In the past few years, the abuse of prescription oral narcotics has grown at an alarming rate. These narcotics are often addictive and abused by patients who may take the medication more frequently than their prescribed rate. Such abuse can lead to severe medical problems for the abuser and can result in death, due to overdosing or extended exposure to the narcotics. Programs designed to treat and prevent such abuse costs society millions of dollars annually. For these reason, physicians are often reluctant to prescribe narcotics to individuals who may need them.

While many types of pill dispensers are known in the art, none limit pill dispensing to a prescribed rate, while reducing the chance for patient abuse of the prescribed medication. Therefore, the need exists for a dispenser that dispenses pills no faster than a prescribed rate and detects tampering with the dispenser. The need also exists for a dispenser that, in the event of user tampering, renders the pills impotent thereby reducing the chance of abuse by the patient. Additional aspects, advantages and other novel features of the invention will be set forth in part in the description that follows and in part will become apparent to those skilled in the art upon examination of the foregoing or may be learned with the practice of the invention.

SUMMARY OF THE INVENTION

In accordance with the purposes of the present invention as described herein, a new and improved pill dispensing device is described. The present invention includes a pill dispenser comprised of a container enclosing a holder, such as a chute, a gate, a sensor, and a neutralizing device.

In one embodiment, the chute contains a plurality of pills for release at a prescribed rate. The gate is positioned in communication with an opening of the chute and movement of the gate from an engaged position to an non-engaged position permits release of a pill from an opening of the chute. The dispensing device also may include a controller.

The controller includes at least one programmable microcontroller. The microcontroller is in communication with a timer, the sensor, and the neutralizing device. Additionally, the microcontroller activates an actuator that functions as a lock and repositions the gate. At a predetermined interval, the microcontroller repositions the gate for release of a pill from the chute.

The sensor, such as a conductive loop, detects tampering with the dispensing device. Upon detection of tampering, the sensor sends a signal to the controller and the controller activates a neutralizing device, thereby rendering the contents of the dispenser impotent.

In the following description there is shown and described one possible embodiment of this invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain certain principles of the invention. In the drawings:

FIG. 7*b* is a diagram showing the conductive loop sensor positioned on the dispenser of FIG. 1;

FIG. 10 is diagram showing one possible embodiment of the pressure sensor of the present invention.

DETAILED DESCRIPTION OF THE INVENTION

Figure 1A:
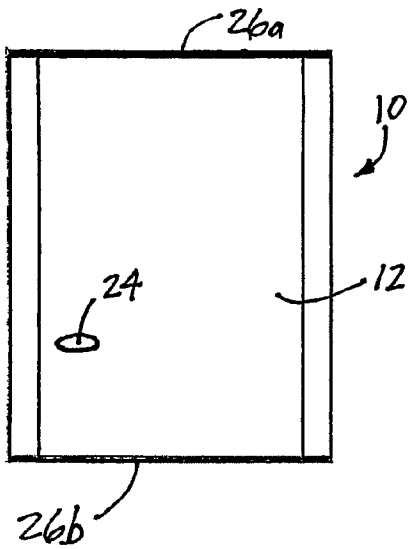
FIG. 1*a* is a side view of the dispenser forming one possible embodiment of the present invention.
Figure 1B:
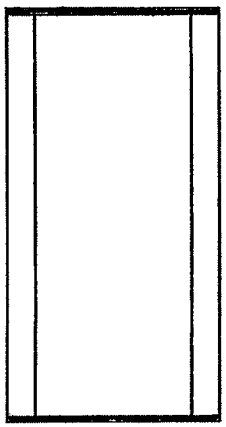
FIG. 1*b* is a rear view of the dispenser of FIG. 1.
Figure 1C:
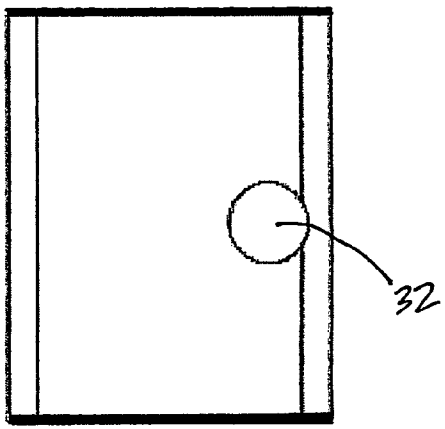
FIG. 1*c* is an opposing side view of the side shown in FIG. 1.
Figure 1D:
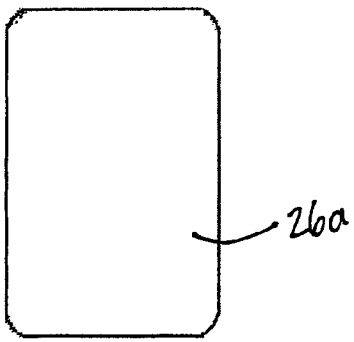
FIG. 1*d* is a top view of the dispenser of FIG. 1.

Reference is now made to FIGS. 1*a-d* and 2 illustrating one embodiment of the pill dispenser 10 of the present invention. In this document, all references to pill(s) relate broadly to all solid, liquid, and gases. Additionally, pills may relate to prescription medication, non-prescription medication, or other. As illustrated, the pill dispenser 10 includes a container 12 having a holder, such as a chute 14, a gate 16, a controller 18, a sensor 20, and a neutralizing device 22.

Figure 3:
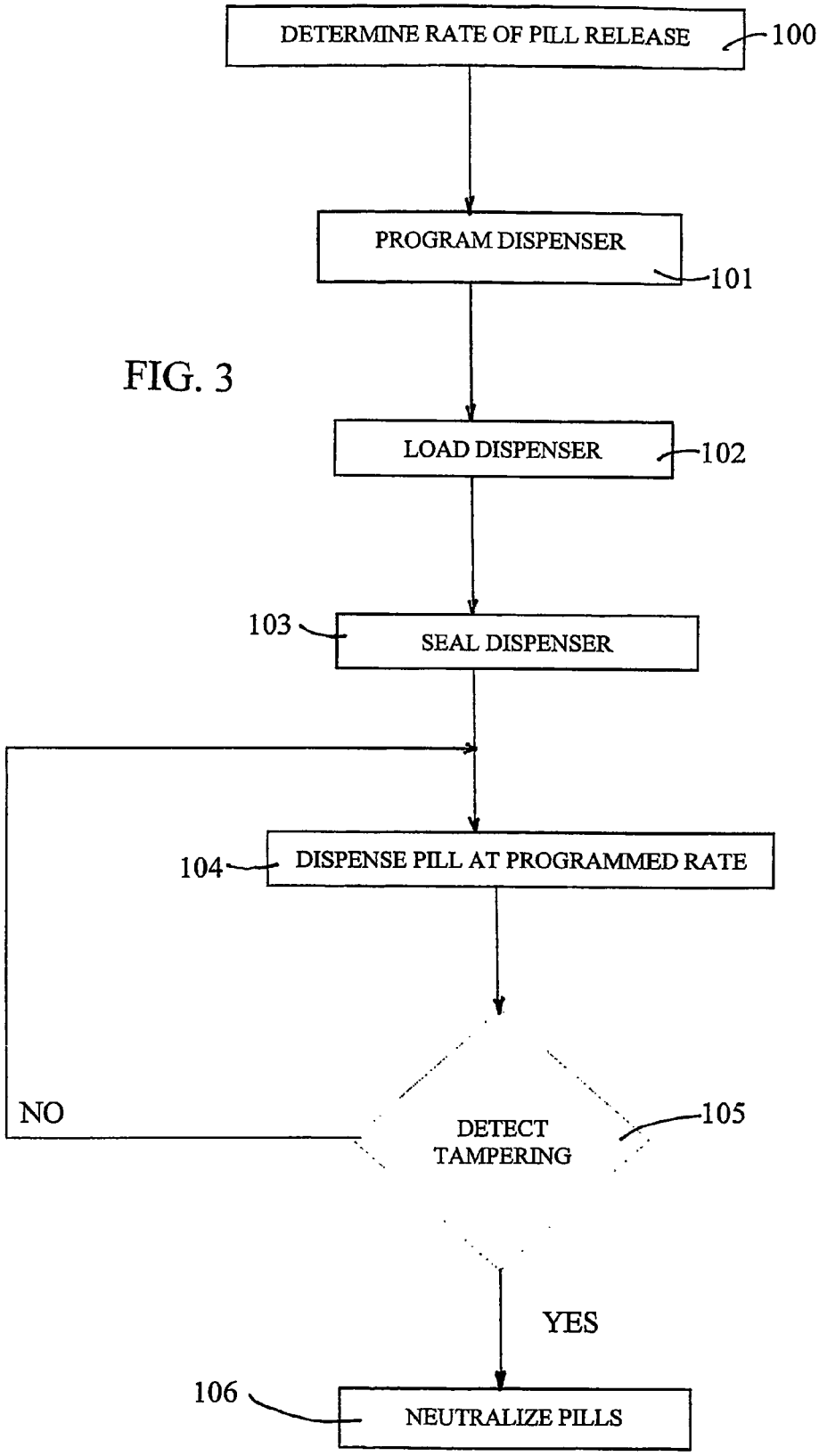
FIG. 3 is a flowchart showing general use and operation of the dispenser of FIG. 1.

The interaction between these elements regulates the release of pills from the dispenser 10. FIG. 3 shows a general overview of use and operation of the dispenser 10. In use, a doctor or other authorized individual determines the rate of pill release (step 100). Next, the pill dispenser 10 is programmed to release pills at this programmed rate (step 101). The dispenser is then loaded with the pills (step 102). After loading, the dispenser is sealed to prevent access to the contents of the dispenser 10 (step 103). The dispenser will then release pills at the programmed rate (step 104). It will continue to release pills at the programmed rate unless it detects tampering with the container (step 105). A sensor 20 detects tampering, such as attempts by an individual to access the contents of the container. If tampering is detected, the sensor 20 detects such activity, sends a signal to the controller 18 and the controller 18 activates a neutralizing device 22, thereby neutralizing the pills (step 106).

The container 12 includes at least one outlet 24, such as an aperture, adapted for dispensing the contents, such as pills (not shown), stored in the container. In one embodiment, the container 12 may include a first and second cover 26*a*, 26*b* designed to seal the contents of the container 12. In this arrangement, the first and second covers 26*a*, 26*b* may attach to the container 12 in a manner to prevent or mitigate a user from tampering with the contents of the container 12. Thus, the covers 26*a*, 26*b* may attach to the container via high strength epoxy, glues, adhesives, welding, soldering, brazing, or otherwise. In addition to the substantially rectangular container 12 shown in FIG. 1, the container may have a substantially cylindrical shape or any other shape, dimensions, or configuration, and be formed from any material. Preferably, the container would be portable and consist of a material, such as stainless steel, polymer/fiber composites, ceramic lined metals, or other materials having the strength and other material properties to withstand neutralization of the container 12 contents (as discussed below in further detail).

Figure 2:
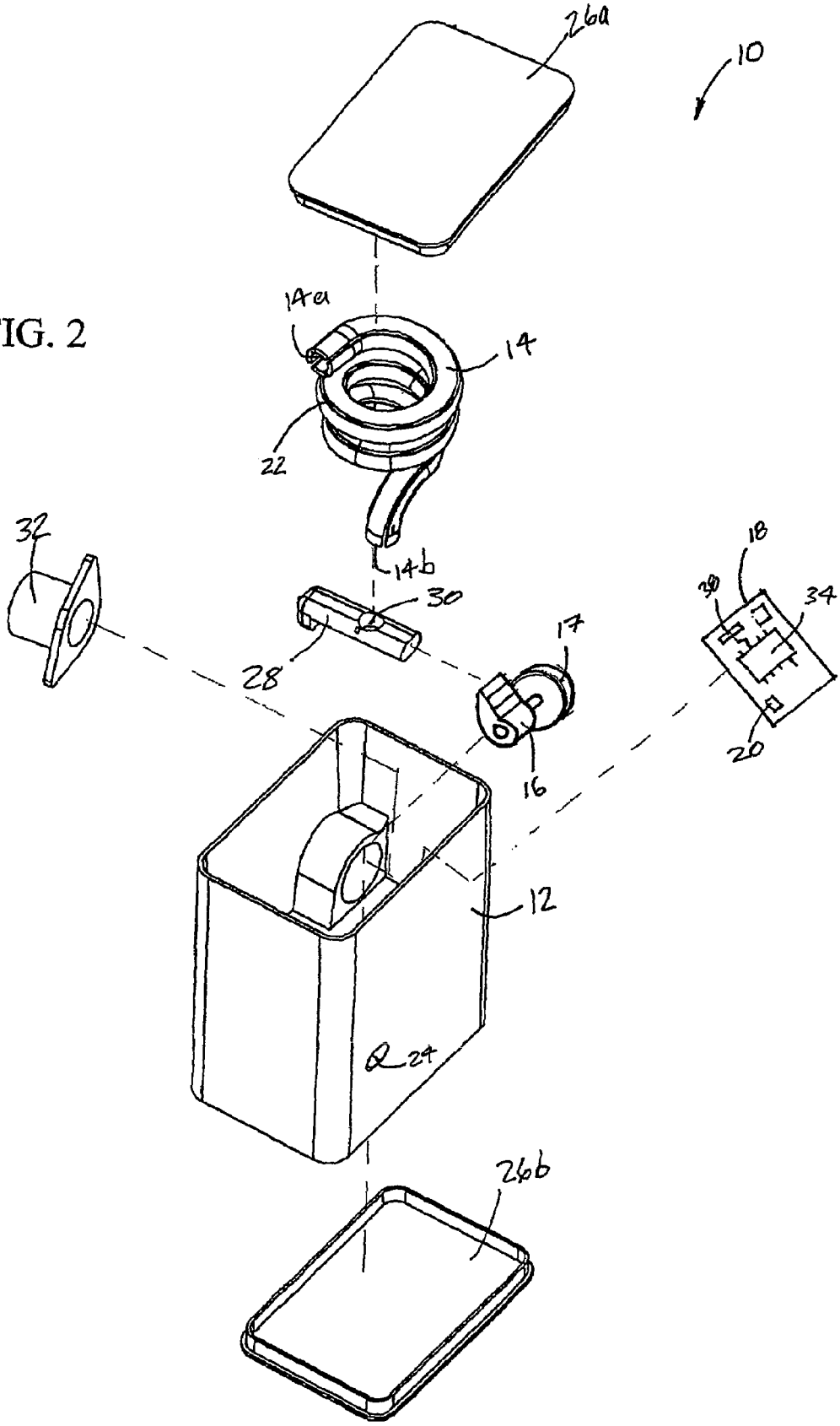
FIG. 2 is an exploded view of the dispenser of FIG. 1.

With reference to FIG. 2, the chute 14 comprises a tube having a first and second opening 14*a*, 14*b* and an internal opening slightly greater than the dimensions of the pills it will retain, so as to provide the necessary clearance to allow pill passage. As shown, the chute 14 may have a substantially helical shape. Alternatively, the chute 14 may be an elongated tube, or be of any suitable shape or size configuration. A gate 16 is positioned in communication with one of the openings 14*a*, 14*b*. In one embodiment, the gate includes a body having an arcuate surface 16*a*. The gate 16 is adapted to substantially cover the outlet 24 of the container 12.

Figure 4:
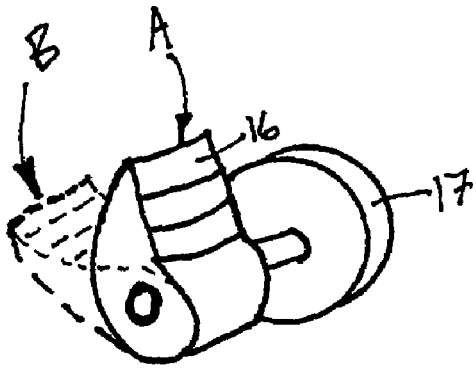
FIG. 4 is a detailed view of the gate and solenoid of FIG. 2, illustrating the engaged and non-engaged positions.

An actuator that functions like a lock, such as a solenoid 17 in communication and activated by the controller 18, repositions the gate 16 from an engaged position A to a non-engaged position B, as shown in FIG. 4*a*. This repositioning permits the release of a pill from an opening of the chute 14. In one embodiment, the dispenser 10 may include a dispensing member 28 having an aperture 30 adapted to receive the pill from the chute 14. In this configuration, the repositioning of the gate 16 permits the movement of the dispensing member 28 and the actual dispensing of a pill. As shown in FIGS. 1 and 2, the container 12 may also include a button 32 linked to the dispensing member 28. When the gate 16 is in the non-engaged position and a user presses the button 32, the dispensing member extends through the outlet 24, thereby allowing the pill to be released to the user. In one embodiment, the button 32 communicates with the controller 18 to reset the timer 38 (as discussed below in further detail). Alternatively, the movement of the gate 16 from the engaged position A to the non-engaged position B automatically releases a pill at the outlet 24 of the container 12.

In one embodiment, the dispenser 10 includes a neutralizing device 22 in proximity to the contents of the chute 14 and the controller 18. As shown, the neutralizing device 22 may consist of a conduit that follows the outline of the chute 14. In this arrangement, the neutralizing device 22 may contain a material for rendering the pills located in the chute 14 impotent. For instance, the neutralizing device 22 may contain a flammable agent, such as model rocket fuel, that is ignited by an ignitor (not shown). Upon receipt of a signal from the controller 18 the ignitor may ignite the flammable agent for destruction of the contents of the dispenser 10. In addition to neutralization via a flammable agent, the neutralizing device 22 may contain a chemical that reacts with the active ingredients in the pill to render the pill physiologically inert.

In addition to the use of chemicals, the neutralizing device 22 may include an epoxy or other hard setting composition for physical encasement of the pills. This may include any quick-set epoxy or other adhesives or polymer known in the art. Additionally, the neutralizing device 22 may include a plunger (not shown) or other mechanical device for physical destruction of the pills.

Figure 5:
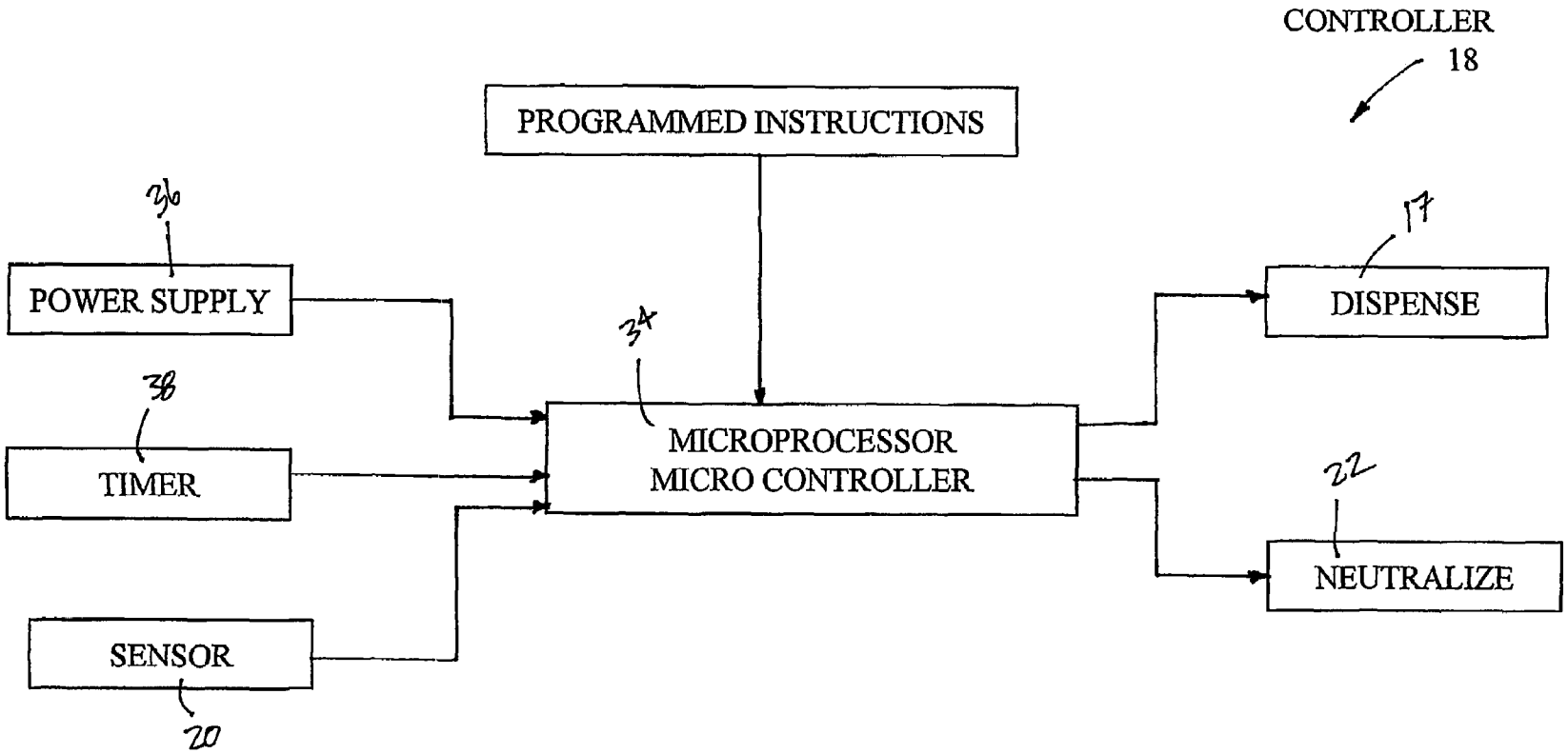
FIG. 5 is a block diagram of one possible embodiment of the controller of the present invention.

FIG. 5 shows a controller 18 for use with the dispenser 10. In one embodiment, the controller 18 includes at least one programmable microcontroller 34, such as the eight-pin microcontroller model number PIC12F675 manufactured by Microchip Technology, Inc., however, any microcontroller 34 may be used. The microcontroller 34 may be programmed with the computer code attached in the Code Appendix, herein incorporated by reference. As shown, the microcontroller 34 receives power from a power supply 36, such as a battery or external power source. In one embodiment, the controller is powered by a standard 9-volt battery, however, any power source that provides the controller with the necessary power may be used.

Figure 6A:
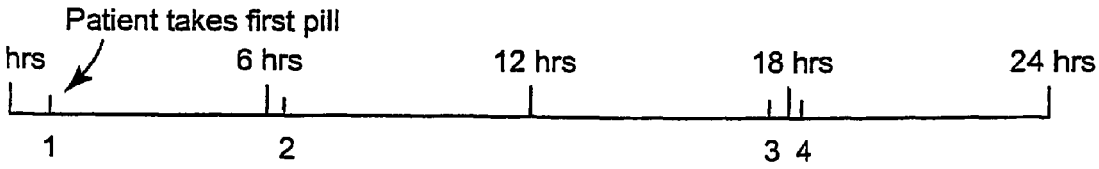
FIGS. 6*a* and 6*b* are diagrams illustrating various algorithms for detecting pill release from the dispenser.

The controller 18 also includes a timer 38 in communication with the microcontroller 34. The timer 38 works with the algorithm programmed in the microcontroller 34 to regulate the release of pills from the chute 14. In its most basic embodiment, the microcontroller 34 may include an algorithm for release of a pill from the chute 14 at a fixed interval of time. As illustrated in FIG. 6*a*, this algorithm would permit the dispenser 10 to release a pill at fixed intervals of time, regardless of the time the user took the pill from the dispenser.

Figure 6B:
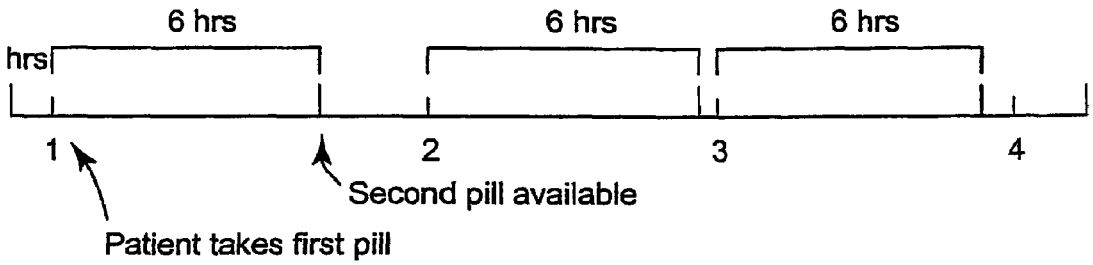

In another embodiment, the microcontroller 34 may include an algorithm for releasing pills at an adjusted fixed interval. As shown in FIG. 6*b*, this algorithm would permit the dispenser 10 to release a pill at a fixed interval after the button 32 was pressed by the user and the pill was removed from the dispenser 10. In this embodiment, if the user was prescribed a pill release rate of 1 pill/4 hours, the dispenser 10 would release the pill 4 hours after the previous pill was removed from the dispenser 10. For instance, if the first pill was removed at 12:00, the next pill would be available at 4:00. However, if the user should forget to take the pill and waited until 5:00 to remove the pill from the dispenser 10, then the next pill would not be available until 9:00. Thus, the microcontroller 34 may include an algorithm for any pill release rate, whether fixed or variable. The microcontroller 34 may be programmed at the time of manufacture or it may be programmed by a drug manufacturer, pharmacist, or other individual authorized to dispense the pills.

In addition to the microcontroller 34 working in conjunction with the timer 30 to release the pills, a sensor 20 is also in communication with the microcontroller 34. The sensor 20 detects tampering with the dispenser 10. If an individual should attempt to access the contents of the dispenser 10, the sensor 20 detects such activity, sends a signal to the microcontroller 34 and the microcontroller 34 activates the neutralizing device 22, thereby rendering the pills impotent.

Figure 7A:
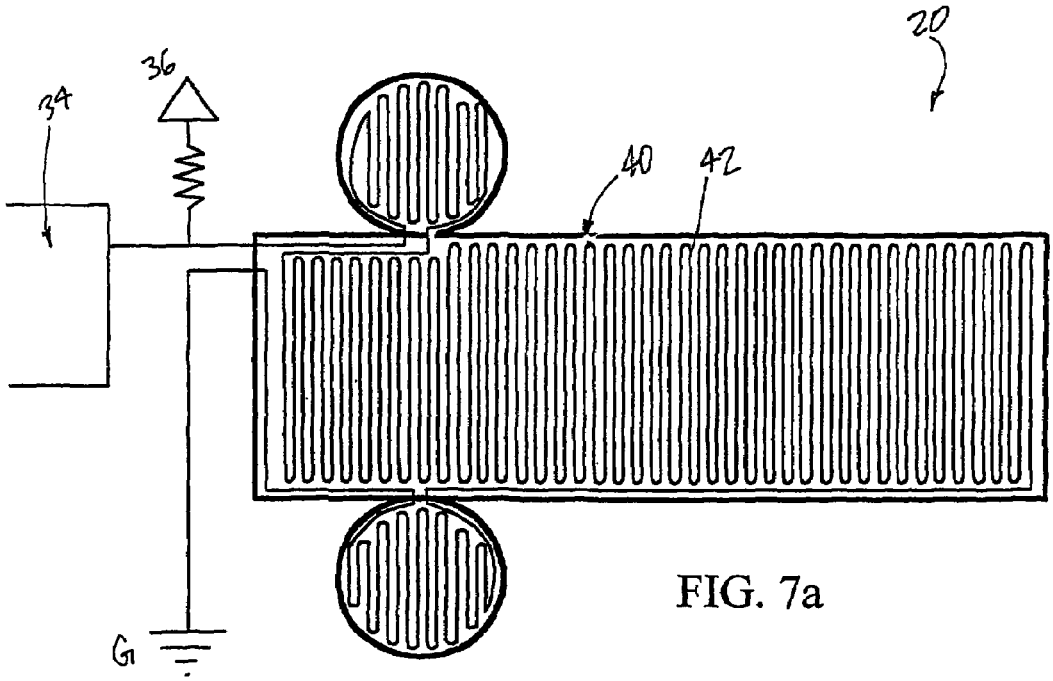
FIG. 7*a* is schematic of one possible embodiment of the conductive loop sensor of the present invention.

In one embodiment shown in FIGS. 7*a* and 7*b*, the sensor 20 consists of a conductive loop 40 encasing the dispenser 10. As shown, the dispenser 10 is wrapped with a thin conductor 42. One end of the conductor 42 connects to ground G, the other connects to the microcontroller 34 and to the power supply 36. The microcontroller 34 is programmed to cause an interrupt on a change in the conductivity of the sensor 20. The conductor 42 is designed to break if the container 12 is broken or cut. When the conductor 42 is broken, the circuit opens and the microcontroller 34 detects an interrupt in the sensor 20. Upon detection of the interrupt in the conductor 42, the microcontroller 34 sends a signal to the neutralizing device 22 causing the neutralizing device 22 to destroy or render the contents of the dispenser impotent. In addition to the configuration of the wire conductor 42 wound around the container, the conductor may also take the form of a conductive pattern printed on paper, or as an etched pattern on a copper layer on the dispenser. Regardless of how the conductor 42 is implemented, the width of the conductor 42 and the spacing between conductors preferably would not exceed the width of a pill stored in the dispenser. Such a configuration would minimize the chances of an individual drilling a hole in the container or otherwise accessing the contents of the container without breaking at least a portion of the conductor 42.

Figure 8:
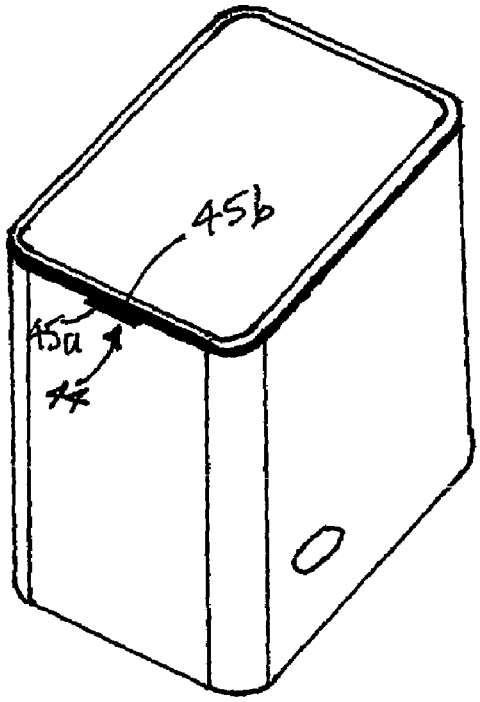
FIG. 8 is a diagram showing one possible embodiment of the pressure sensitive switch positioned on the dispenser of FIG. 1.

In another embodiment, shown in FIG. 8, the sensor 20 includes a pressure sensitive switch 44 consisting of two layers of conductive material 45*a*, 45*b* separated by a small gap 46. If the dispenser 10 is crushed or cut, the two layers 45*a*, 45*b* will touch each other causing a short circuit. When the microcontroller detects a short circuit it actuates the neutralizing device.

Figure 9:
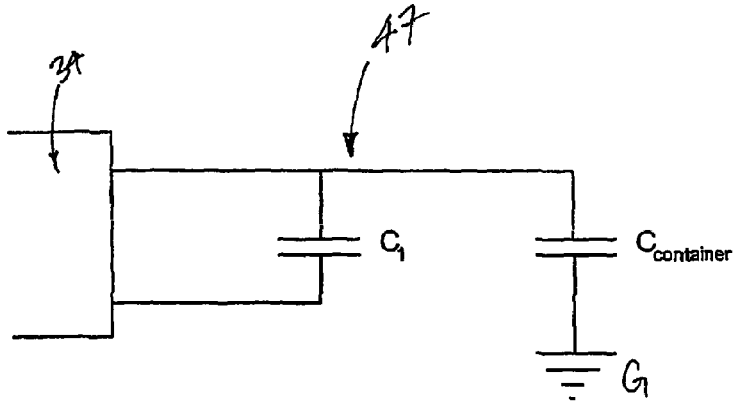
FIG. 9 is schematic of one possible embodiment of the capacitive sensor of the present invention.

In yet another embodiment, representatively shown in FIG. 9, the sensor 20 comprises a capacitive sensor 47 made using a plurality of layers of conductive foil material separated by an insulator. The capacitance of the container depends on the spacing of the layers and the shape of the dispenser 10. Crushing, cutting, or other attack that changes the shape of the dispenser 10 will change its capacitance. The microcontroller 34 measures the capacitance, triggering the neutralizing device if the capacitance changes significantly. As shown in FIG. 9, $C_{container}$ represents the capacitance of the container and $C_1$ is a known capacitance. The microcontroller 34 or power supply 36 repeatedly charges $C_{container}$ and distributes the charge between $C_1$ and $C_{container}$. The number of charge-discharge cycles required to make the voltage of $C_1$ reach a certain threshold is proportional to the capacitance of $C_{container}$. The capacitive sensor 47 does not require a DC path between power and ground, but it does require the microcontroller 34 to be active to measure the capacitance of the container.

In another embodiment, shown in FIG. 10, the dispenser 10 is pressurized and the sensor 20 comprises a pressure sensor 48, as known in the art. By comparing the internal pressure of the container with the external pressure outside the container, tampering can be detected. If the pressure detected inside the dispenser 10 by the sensor 48 drops below a predetermined threshold value, the microprocessor 34 will activate the neutralizing device 22. Additionally, a change in the internal pressure of the dispenser 10 could also mechanically trigger a neutralizing device 22.

The present invention presents a pill dispenser 10 that dispenses pills no faster than a prescribed rate. Additionally, the dispenser detects tampering and, in the event of user tampering, renders the pills impotent.

The foregoing descriptions of various embodiments of the invention are provided for purposes of illustration, and are not intended to be exhaustive or limiting. Modifications or variations are also possible in light of the above teachings. For instance, in addition to the examples shown, the dispenser 10 may include any type of controller and/or sensor arrangement for detecting tampering. The dispenser 10 and its components may also form part of a kit including instructions on how to use it for controlling the rate of pill release and detect tampering. Additionally, the container and/or dispenser may be used for storing biological or organic hazards, such as anthrax. Upon detection of tampering with the container or dispenser the neutralizing device could destroy or render the biological or organic hazard inert. The embodiments described above were chosen to provide the best application to thereby enable one of ordinary skill in the art to utilize the disclosed inventions in various embodiments and with various modifications as are suited to the particular use contemplated. All such modifications and variations are within the scope of the invention as determined by the appended claims when interpreted in accordance with the breadth to which they are fairly, legally and equitably entitled.

CODE APPENDIX

```
    ;; Assembly code for PillSafe
    ;;
    list p=12f675
    include "p12f675.inc"
timer_cnt           equ   0x20
isr_w_save          equ   0x21
isr_status_save     equ   0x22
WAIT_H              equ   0x23
WAIT_L              equ   0x24
CNT1                equ   0x25
CNT0                equ   0x26
GP_SOLENOID         equ   0x0
GP_BUTTON_USER      equ   0x1
GP_LED              equ   0x2
GP_BUTTON_DONE      equ   0x3
    _CONFIG _CPD_OFF &_CP_OFF
    & _BODEN_OFF & _MCLRE_OFF & _PWRTE_OFF
    & _WDT_OFF & _INTRC_OSC_NOCLKOUT
    goto main
    org 0x004
dispatch_interrupt:
    ;; save W, STATUS
    movwf isr_w_save
    swapf STATUS, W          ; swapf does not affect status reg.
    movwf isr_status_save
    btfsc PIR1, TMR1IF       ; did we get here because of a timer1
                             overflow?
    call timer1_isr
    btfsc INTCON, GPIF       ; interrupt on GPIO pin?
    call gpio_change_isr
    ;; restore W, Status
    swapf isr_status_save, W
    movwf STATUS
    swapf isr_w_save, F      ; swapf does not affect STATUS
    swapf isr_w_save, W
    retfie
timer1_isr:
    ;; clear timer interrupt flag, and set timer_cnt flag
    bcf PIR1, TMR1IF
;   bsf timer_cnt, 0
    return
gpio_change_isr:
    ;; read from GPIO to prevent GPIF getting set again, and clear GPIF
    movf GPIO, F
    bcf INTCON, GPIF
    return
    ;; main
main:
    bcf STATUS, RP0
    clrf GPIO
    movlw 0x7
    movwf CMCON              ; disable comparator
    clrf TMR0
    mov1w 0x40               ; enable peripheral interrupts
    movwf INTCON
```

CODE APPENDIX-continued

```
    clrf T1CON                  ; timer1 off
    clrf TMR1L                  ; clear timer1
    clrf TMR1H
    clrf PIR1
    clrf ADCON0
    ;; ****************************************************
    ;; BANK1
    ;; ****************************************************
    bsf STATUS, RP0
    mov1w -((1 << GP_SOLENOID) | (1 << GP_LED))
    movwf TRISIO
    clrf VRCON
    clrf OPTION_REG             ; enable weak pull-ups
    clrf WPU                    ; use pull-ups with buttons
    clrf ANSEL
    mov1w 0x01                  ; enable timer1 interrupt
    movwf PIE1
    bcf STATUS, RP0
    ;; ****************************************************
    ;; BANK0
    ;; ****************************************************
    bsf INTCON, GIE ; enable all unmasked interrupts
infinite:
    mov1w 0x03                  ; WAIT = 0x0203
    movwf WAIT_L
    mov1w 0x02
    movwf WAIT_H
    call wait_long
    bsf GPIO, GP_LED
    call wait_for_button
    bcf GPIO, GP_LED
    call dispense
    goto infinite
;;; ************************************************************
;;; wait_for_timeout - sleep until the desired time has passed expires
;;; ************************************************************
;;; TODO: longer delays, sleep wait
wait_for_timeout:
    ;; setup timer interrupt
    clrf T1CON                  ; timer1 off
    clrf TMR1L                  ; clear timer1
    clrf TMR1H
    mov1w 0x0f                  ; timer1 always on, prescale 8:1
                                ;   LP oscillator, async mode, timer1 on
    movwf T1CON
    bcf     PIR1, TMR1IF
    bsf     STATUS, RP0         ; *** bank1
    bsf PIE1, TMR1IE            ; enable timer1 interrupt
    bcf STATUS, RP0             ; *** bank0
    ;; sleep (or wait) repeatedly until timeout period is over
    sleep
;   bcf timer_cnt, 0
; t_wait:     btfss timer_cnt, 0
;   goto t_wait
    ;; Disable timer and timer interrupt
    bsf STATUS, RP0             ; *** bank1
    bcf     PIE1, TMR1IE
    bcf STATUS, RP0             ; *** bank0
    return
;;; ************************************************************
;;; wait_long - Decrement WAIT_L to
0 WAIT_H times with prescale set
;;;         to 8:1.
;;; When WAIT_L is 15, this WAIT_H will be the number of 4
;;; minute intervals. When WAIT_L is 225, WAIT_H is the number
;;; of hours to wait.
;;; ASSUME: WAIT_H and WAIT_L are both at least 1
;;; ************************************************************
wait_long:
    clrf T1CON ; turn timer1 off
    ;; setup tmr1h and tmr1l
    clrf TMR1L
    clrf TMR1H
    mov1w ((1<<T1CKPS1) | (1<<T1CKPS0) | (1<<T1OSCEN) |
    (1<<NOT_T1SYNC) | (1<<TMR1CS) | (1<<TMR1ON))
    movwf T1CON
    movf WAIT_H, W
    movwf CNT1
```

CODE APPENDIX-continued

```
wait_long_loop_h:               ; do {
    movf WAIT_L, W
    movwf CNT0
wait_long_loop_1:               ; do {
    call wait_for_timer1
    decfsz CNT0, F              ; }   while(CNT0 > 0);
    goto wait_long_loop_1
    decfsz CNT1, F              ;         } while(CNT1 > 0);
    goto wait_long_loop_h
    bcf T1CON, TMR1ON
    return
;;; ************************************************************
;;; wait_ticks - sleep for number of timer1 ticks in WAIT_H, WAIT_L
;;; ************************************************************
wait_ticks:
    clrf T1CON                  ; turn timer1 off, prescaling to 1:1
    ;; setup tmr1h and tmr1l
    comf WAIT_L, W
    movwf TMR1L
    comf WAIT_H, W
    movwf TMR1H
    incfsz TMR1L, F
    decf TMR1H, F
    incf TMR1H, F
    mov1w ((1<<T1OSCEN) | (1 <<NOT_T1SYNC) |
    (1<<TMR1CS) | (1<<TMR1ON))
    movwf T1CON
    call wait_for_timer1
    bcf T1CON, TMR1ON
    return
;;; ************************************************************
;;; wait_for_timer1 - sleep until timer1 interrupts
;;;
;;; ASSUME: TMR1L, TMR1H, and prescaling bits are already set
;;; ASSUME: The value in TMR1H & TMR1L is big enough that timer1
;;;         will not interrupt before wait for_timer1 sleeps
;;; ASSUME: No extraneous interrupts will wake
wait_for_timer1 from sleep
;;; ************************************************************
;;; TODO: longer delays, sleep wait
wait_for_timer1:
    bcf PIR1, TMR1IF
    ;; TODO: maybe leave timer1 interrupt enabled all the time.
    ;; As long as timer is off, no interrupts will happen
    bsf STATUS, RP0             ; *** bank1
    bsf PIE1, TMR1IE            ; enable timer1 interrupt
    bcf STATUS, RP0             ; *** bank0
    ;; sleep repeatedly until timeout period is over sleep
    ;; Disable timer and timer interrupt
    bsf STATUS, RP0             ; *** bank1
    bcf PIE1, TMR1IE
    bcf STATUS, RP0             ; *** bank0
    return
;;; ************************************************************
;;; wait_for_button - sleep until a button is pressed
;;; ************************************************************
wait_for_button:
    ;; setup button interrupt
    bsf STATUS, RP0             ; *** bank1
    bsf WPU, GP_BUTTON_USER
    bsf IOC, GP_BUTTON_USER
    bcf STATUS, RP0 ; *** bank0
    bsf INTCON, GPIE
    ;; sleep until button interrupt
    ;; TODO: is polling the button necessary, or even a good thing?
sleep_wait
    sleep
    btfsc GPIO, GP_BUTTON_USER
    goto sleep_wait
    ;; disable button interrupt
    bcf INTCON, GPIE
    bsf STATUS, RP0             ; *** bank1
    bcf IOC, GP_BUTTON_USER
    bcf WPU, GP_BUTTON_USER
    bcf STATUS, RP0             ; *** bank0
    return
;;; ************************************************************
;;; dispense - dispense a pill (activate the solenoid)
;;; ************************************************************
```

CODE APPENDIX-continued

```
dispense:
;; enable solenoid and sleep until it has moved (use 100 ms)
bsf GPIO, GP_SOLENOID ; GP_SOLENOID = 1
    mov1w 0xcd                ; WAIT = 0x0ccd
    movwf WAIT_L
    mov1w 0x0c
    movwf WAIT_H
    call wait_ticks           ; wait_ticks( )
    bcf GPIO, GP_SOLENOID ; GP_SOLENOID = 0
    return
    end
```

The invention claimed is:

1. A product dispenser, comprising:

a container;

a holder held in said container for holding multiple units of a product;

a gate carried on said holder, said gate being selectively displaceable between an engaged position for retaining product in said holder within said chamber and an non-engaged position for dispensing a single unit of said product from said holder;

a lock for securing said gate in said engaged position; and a neutralizing device in proximity to the holder.

2. The product dispenser of claim 1, comprising: a controller in communication with said lock for regulating the movement of said gate.

3. The product dispenser of claim 1, comprising: a sensor for detecting tampering of said dispenser.

4. A pill dispenser, comprising:

a container;

a holder having a first and second opening, said holder positioned substantially within an interior of said container;

a displaceable gate positioned in communication with one opening of said holder;

a lock for preventing displacement of said gate;

a controller in communication with said lock for regulating the movement of said gate, said controller includes at least one programmable microcontroller; and a sensor in communication with the microcontroller, said sensor includes a conductive loop encasing said dispenser.

5. The dispenser of claim 4, wherein said container includes at least one aperture in communication with one opening of said holder.

6. The dispenser of claim 5, wherein said holder is a chute having a substantially helical shape.

7. The dispenser of claim 4, wherein said dispenser includes a dispensing member having at least one aperture adapted for receiving a pill.

8. The dispenser of claim 7, wherein said aperture of said dispensing member is in communication with one opening of said holder.

9. The dispenser of claim 8, wherein said gate controls the movement of said dispensing member.

10. A pill dispenser, comprising:

a container having at least one aperture;

a dispensing member having at least one aperture adapted for receiving a pill;

a chute having a first and second opening, wherein at least one of said openings is in communication with said at least one aperture of said dispensing member, said chute positioned substantially within an interior of said container;

a gate controlling the movement of said dispensing member;

an actuator for repositioning the gate from an engaged position to a non-engaged position;

a button linked to said dispensing member for extending said dispensing member through said aperture of said container;

a controller including at least one programmable microcontroller to regulate the release of said pill from said chute; a sensor in communication with said microcontroller; a neutralizing device in proximity to the contents of said chute and said controller.

11. The pill dispenser of claim 10, wherein said dispenser is pressurized and said sensor comprises a pressure sensor capable of measuring an internal pressure of said container and an external pressure outside said container.

12. The pill dispenser of claim 11, wherein the neutralizing device is a flammable agent.

13. The pill dispenser of claim 10, wherein the neutralizing device is a flammable agent.

14. A method for dispensing pills, comprising:

determining a rate of release for a pill;

programming a pill dispenser to release said pill at said rate;

loading said dispenser with said pill;

sealing said dispenser;

releasing said pill at said programmed release rate;

detecting tampering of said dispenser; and upon detection of tampering, neutralizing said pills in said dispenser via a neutralizing device.

15. The method of claim 14, wherein the detecting step comprises a using a sensor in communication with a controller.

16. The method of claim 15, further comprising the step of pressurizing said dispenser.

17. The method of claim 16, wherein the sensor comprises a pressure sensor capable of measuring an internal pressure in said dispenser and comparing said pressure with an external pressure outside said dispenser.

18. The method of claim 14, wherein said neutralizing device comprises use of a flammable agent.

19. A pill dispenser, comprising:

a container;

a holder having a first and second opening, said holder positioned substantially within an interior of said container;

a displaceable gate positioned in communication with one opening of said holder;

a lock for preventing displacement of said gate;

a controller in communication with said lock for regulating the movement of said gate, said controller includes at least one programmable microcontroller; and a sensor in communication with the microcontroller, said sensor includes a pressure sensitive switch consisting of at least two layers of conductive material separated by a gap.

20. The dispenser of claim 19, wherein said container includes at least one aperture in communication with one opening of said holder.

21. The dispenser of claim 20, wherein said holder is a chute having a substantially helical shape.

22. The dispenser of claim 19, wherein said dispenser includes a dispensing member having at least one aperture adapted for receiving a pill.

23. The dispenser of claim 22, wherein said aperture of said dispensing member is in communication with one opening of said holder.

24. The dispenser of claim 23, wherein said gate controls the movement of said dispensing member.

25. A pill dispenser, comprising:

a container;

a holder having a first and second opening, said holder positioned substantially within an interior of said container;

a displaceable gate positioned in communication with one opening of said holder;

a lock for preventing displacement of said gate;

a controller in communication with said lock for regulating the movement of said gate, said controller includes at least one programmable microcontroller; and a sensor in communication with the microcontroller, said pill dispenser is pressurized and said sensor comprises a pressure sensor capable of measuring an internal pressure of said container and an external pressure outside said container.

26. The dispenser of claim 25, wherein said container includes at least one aperture in communication with one opening of said holder.

27. The dispenser of claim 26, wherein said holder is a chute having a substantially helical shape.

28. The dispenser of claim 25, wherein said dispenser includes a dispensing member having at least one aperture adapted for receiving a pill.

29. The dispenser of claim 28, wherein said aperture of said dispensing member is in communication with one opening of said holder.

30. The dispenser of claim 29, wherein said gate controls the movement of said dispensing member.

31. A pill dispenser, comprising:

a container;

a holder having a first and second opening, said holder positioned substantially within an interior of said container;

a displaceable gate positioned in communication with one opening of said holder;

a lock for preventing displacement of said gate;

a controller in communication with said lock for regulating the movement of said gate, said controller includes at least one programmable microcontroller; and a sensor in communication with the microcontroller, wherein said pill dispenser includes a neutralizing device in proximity to the holder.

32. The dispenser of claim 31, wherein said container includes at least one aperture in communication with one opening of said holder.

33. The dispenser of claim 32, wherein said holder is a chute having a substantially helical shape.

34. The dispenser of claim 31, wherein said dispenser includes a dispensing member having at least one aperture adapted for receiving a pill.

35. The dispenser of claim 34, wherein said aperture of said dispensing member is in communication with one opening of said holder.

36. The dispenser of claim 35, wherein said gate controls the movement of said dispensing member.

* * * * *